US007403088B2

(12) United States Patent
Fischer et al.

(10) Patent No.: US 7,403,088 B2
(45) Date of Patent: Jul. 22, 2008

(54) HANDLE APPARATUS AND ELECTRICAL SWITCHING APPARARTUS EMPLOYING THE SAME

(75) Inventors: Kenneth M. Fischer, Union Township, PA (US); Vicki D. Fodi, Beaver Falls, PA (US); Glen C. Sisson, Center Township, PA (US)

(73) Assignee: Eaton Corporation, Cleveland, OH (US)

( * ) Notice: Subject to any disclaimer, the term of this patent is extended or adjusted under 35 U.S.C. 154(b) by 301 days.

(21) Appl. No.: 11/170,630

(22) Filed: Jun. 29, 2005

(65) Prior Publication Data

US 2007/0001791 A1 Jan. 4, 2007

(51) Int. Cl.
*H01H 13/04* (2006.01)

(52) U.S. Cl. ..... 335/202; 200/293; 200/294

(58) Field of Classification Search ..... 200/293–307; 335/202; 202/293–307

See application file for complete search history.

(56) References Cited

U.S. PATENT DOCUMENTS 4,761,521 A 8/1988 Beck et al.
6,144,001 A * 11/2000 Green et al. ..... 200/304

* cited by examiner

*Primary Examiner*—Ramon M Barrera
(74) *Attorney, Agent, or Firm*—Martin J. Moran

(57) ABSTRACT

An electrical switching apparatus includes a circuit breaker device having a molded housing with line and load ends, plural terminals disposed from the housing, and first and second handle devices. The terminals electrically and mechanically engage a circuit breaker mounting block. The first and second handle devices engage the housing at or about the respective line and load ends. The handle devices remove the circuit breaker device from the mounting block. Each of the handle devices includes an insulative barrier having a first portion, a second portion and a third portion. The first portion at least partially covers a corresponding one of the housing ends. The second portion is coupled to the housing at or about the corresponding one of the housing ends. The third portion is structured to be manually grasped in order to pull the insulative barrier together with the circuit breaker device away from the mounting block.

2 Claims, 4 Drawing Sheets

HANDLE APPARATUS AND ELECTRICAL SWITCHING APPARARTUS EMPLOYING THE SAME

BACKGROUND OF THE INVENTION

1. Field of the Invention

This invention pertains generally to electrical switching apparatus and, more particularly, to an apparatus, such as a circuit breaker, for mounting or plugging-in to a mounting block, such as a plug-in mounting block. The invention also pertains to a mechanism for removing a circuit breaker from a mounting block.

2. Background Information

Electrical switching apparatus, such as circuit interrupters, include, for example, circuit breakers, contactors, motor starters, motor controllers and other load controllers having a trip mechanism. Circuit breakers are generally old and well known in the art. Circuit breakers are used to protect electrical circuitry from damage due to an overcurrent condition, such as an overload condition or a relatively high level short circuit or fault condition.

It is known to provide an electrical switching apparatus including a molded housing having molded slots between phases, with insulative interphase barriers or terminal shields disposed in those molded slots.

It is known to provide an electrical switching apparatus, such as, for example, a circuit breaker, that is mounted or plugged-in to a mounting or plug-in block, which includes line and load power busses. This permits a maintenance person to remove the circuit breaker by pulling the mounted circuit breaker away from the plug-in block. However, problems might arise during the removal process. For example, known conventional circuit breakers do not include convenient surfaces that can be readily and safely grasped by the maintenance person to pull the circuit breaker for removal from the plug-in block. Also, other known surfaces that might be grasped by the maintenance person often are proximate electrically conductive components, such as, for example, line or load terminals. As a result, the maintenance person may experience difficulty, if not dangers, during the removal process.

Accordingly, there is room for improvement in electrical switching apparatus that is mounted or plugged-in to a mounting or plug-in block.

SUMMARY OF THE INVENTION

These needs and others are met by the present invention, which provides a handle apparatus for engaging a housing of an electrical switching apparatus and for removing the electrical switching apparatus from a mounting block. An insulative barrier includes a first portion structured to at least partially cover plural terminals of the electrical switching apparatus, a second portion structured to couple to or about the housing of the electrical switching apparatus, and a third portion structured to be manually grasped in order to pull the insulative barrier together with the electrical switching apparatus away from a mounting block.

In accordance with one aspect of the invention, a handle apparatus for engaging a housing of an electrical switching apparatus and for removing the electrical switching apparatus from a mounting block comprises: an insulative barrier comprising a first portion, a second portion and a third portion, wherein the first portion of the insulative barrier is structured to at least partially cover plural terminals of the electrical switching apparatus, wherein the second portion of the insulative barrier is structured to couple to the housing of the electrical switching apparatus, and wherein the third portion of the insulative barrier is structured to be manually grasped in order to pull the insulative barrier together with the electrical switching apparatus away from the mounting block.

The first portion of the insulative barrier may include a first side structured to be disposed away from the housing of the electrical switching apparatus and an opposite second side structured to be disposed with the second portion of the insulative barrier toward the housing of the electrical switching apparatus. The third portion of the insulative barrier may be a grab handle portion disposed away from the first side of the insulative barrier and away from the housing of the electrical switching apparatus.

The insulative barrier may further include a fourth portion. The first and fourth portions of the insulative barrier may form an L-shaped cover.

The housing of the electrical switching apparatus may include at least one groove portion. The second portion of the insulative barrier may include at least one tongue portion structured to engage the at least one groove portion.

The tongue portions may include a member disposed from the first portion of the insulative barrier, the member including a locking rib. The groove portions of the housing of the electrical switching apparatus may include a slot having a channel structured to receive the locking rib.

Each of the tongue portions of the second portion of the insulative barrier may include a first free end structured to slide into a corresponding one of the groove portions and a second end coupled to the fourth portion.

As another aspect of the invention, an electrical switching apparatus for mounting to a mounting block comprises: an electrical switching device comprising a housing including a first housing portion and a second housing portion, and a plurality of terminals disposed from the housing, the terminals being structured to electrically and mechanically engage the mounting block; and first and second handle devices, the first handle device engaging the housing of the electrical switching device at or about the first housing portion, the second handle device engaging the housing of the electrical switching device at or about the second housing portion, the first and second handle devices being structured to remove the electrical switching device from the mounting block, each of the first and second handle devices comprising: an insulative barrier comprising a first portion, a second portion and a third portion, wherein the first portion of the insulative barrier at least partially covers a corresponding one of the first and second housing portions, wherein the second portion of the insulative barrier is coupled to the housing at or about the corresponding one of the first and second housing portions, and wherein the third portion of the insulative barrier is structured to be manually grasped in order to pull the insulative barrier together with the electrical switching device away from the mounting block.

As another aspect of the invention, an electrical switching apparatus comprises: a mounting block; an electrical switching device comprising a housing including a first housing portion and a second housing portion, and a plurality of terminals disposed from the housing, the terminals electrically and mechanically engaging the mounting block; and first and second handle devices, the first handle device engaging the housing of the electrical switching device at or about the first housing portion, the second handle device engaging the housing of the electrical switching device at or about the second housing portion, the first and second handle devices being structured to remove the electrical switching device from the mounting block, each of the first and second handle devices comprising: an insulative barrier comprising a first portion, a second portion and a third portion, wherein the first portion of the insulative barrier at least partially covers a corresponding one of the first and second housing portions, wherein the second portion of the insulative barrier is coupled to the housing at or about the corresponding one of the first and second housing portions, and wherein the third portion of the insulative barrier is structured to be manually grasped in order to pull the insulative barrier together with the electrical switching device away from the mounting block.

The mounting block may be a plug-in block including a plurality of openings. The terminals of the electrical switching device may plug-in to the plug-in block at the openings thereof.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The present invention is described in association with endcap circuit breaker removal grab handles for a three-phase circuit breaker, although the invention is applicable to a wide range of handle apparatus and electrical switching apparatus having any number of phases or poles.

Figure 1:
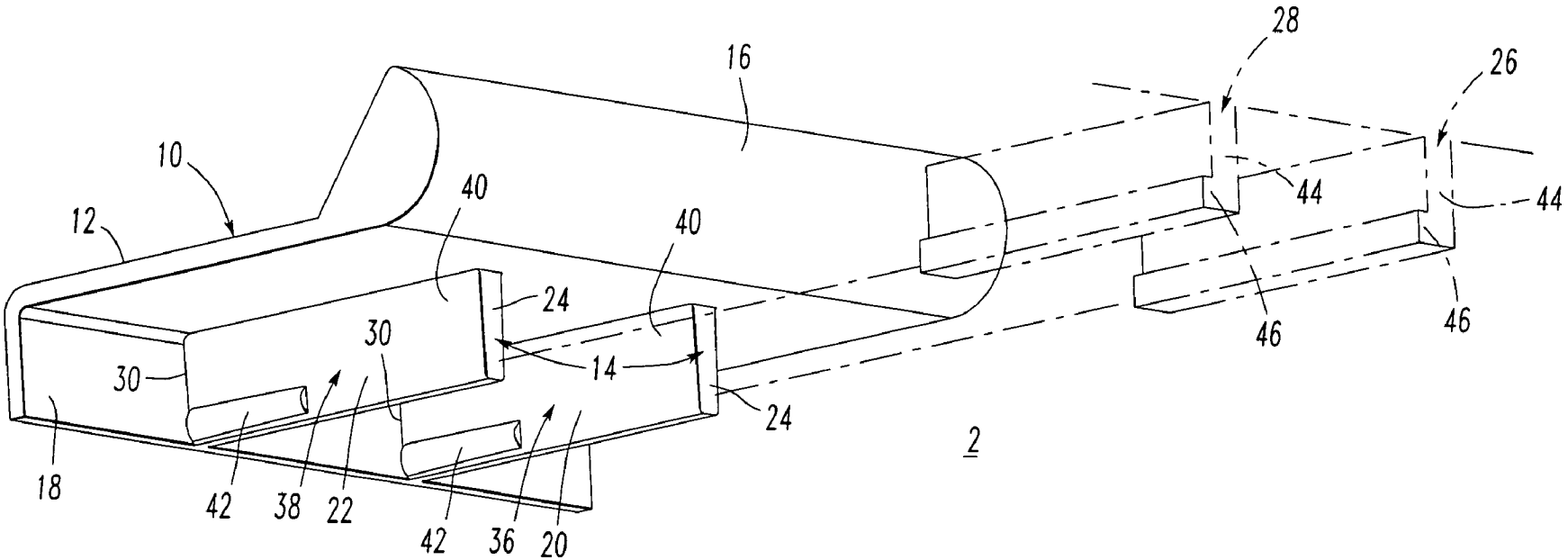
FIG. 1 is an isometric view of an endcap circuit breaker removal grab handle in accordance with the present invention.
Figure 2:
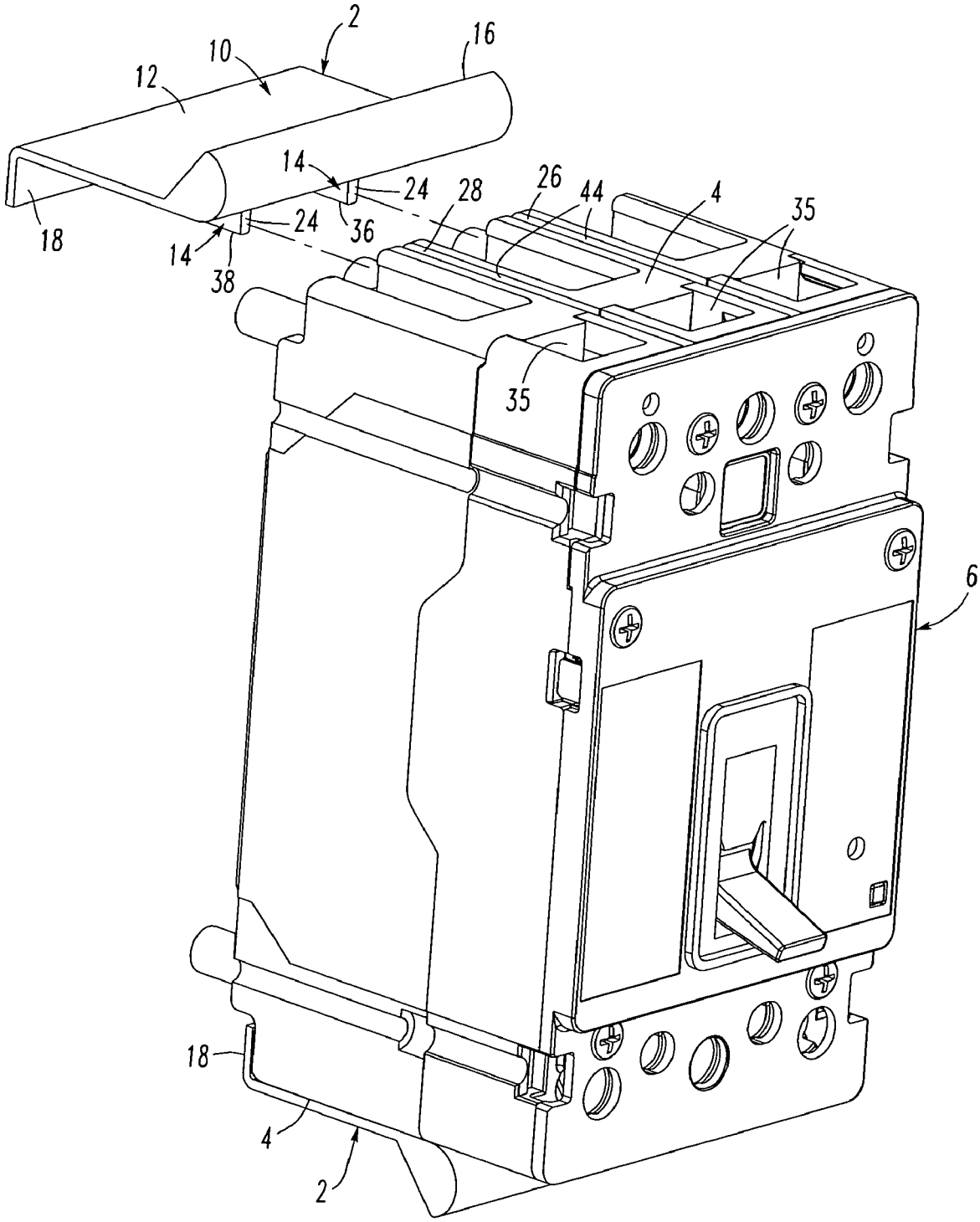
FIG. 2 is a partially exploded isometric view of a circuit breaker including two of the endcap circuit breaker removal grab handles of FIG. 1.

Referring to FIGS. 1 and 2, a handle apparatus, such as an endcap circuit breaker removal grab handle 2, is shown. The example endcap circuit breaker removal grab handle 2 engages the housing 4 (e.g., without limitation, a molded base) of an electrical switching apparatus, such as a three-phase, molded case circuit breaker 6 (FIG. 2). As will be discussed, below, in connection with FIGS. 3 and 4, two endcap circuit breaker removal grab handles 2 are employed to remove the circuit breaker 6 from a mounting block, such as a plug-in block 8.

Figure 3:
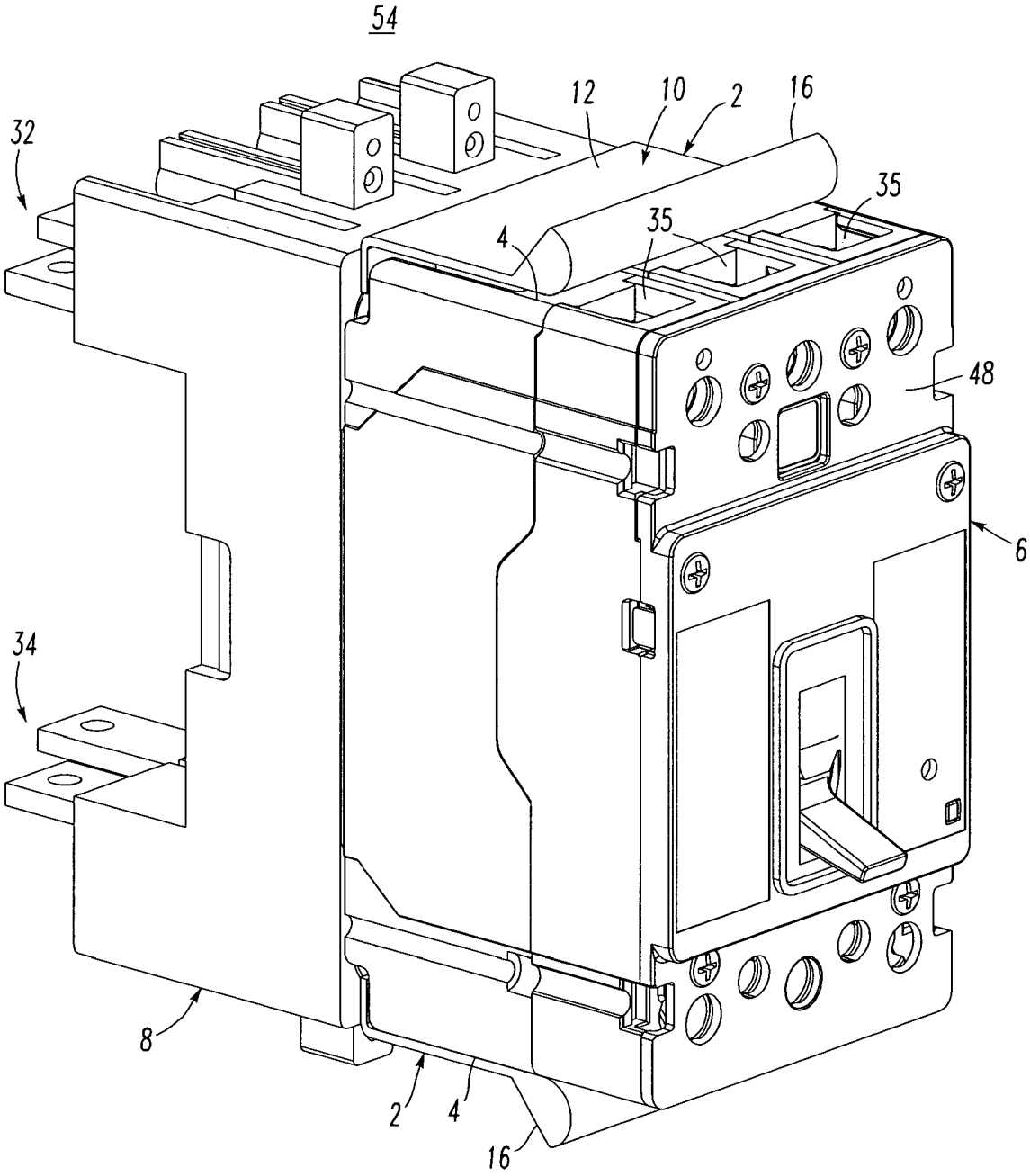
FIG. 3 is an isometric view of the circuit breaker and the endcap circuit breaker removal grab handles of FIG. 2 as mounted on a plug-in block.
Figure 4:
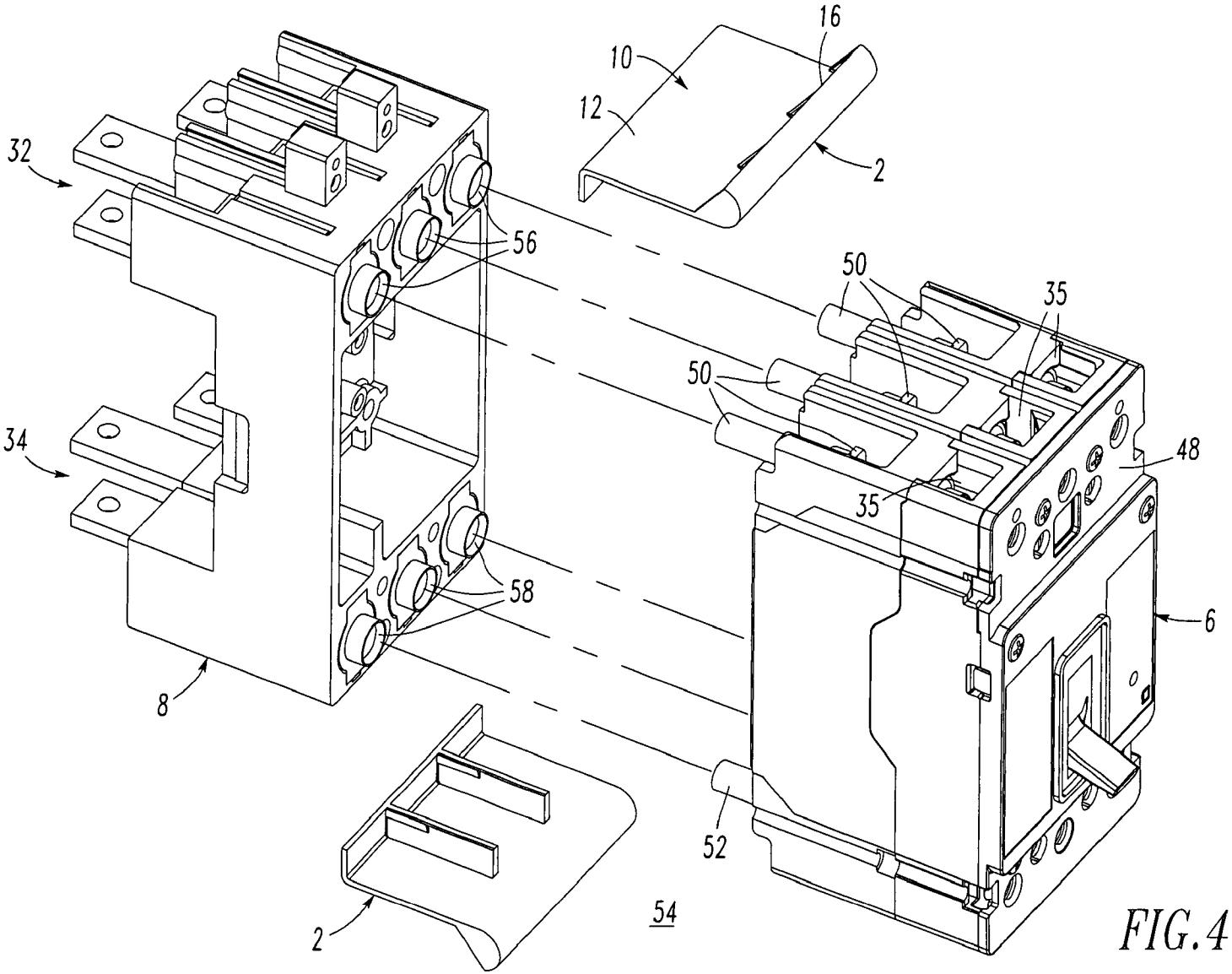
FIG. 4 is an exploded isometric view of the circuit breaker, the endcap circuit breaker removal grab handles and the plug-in block of FIG. 3.

Continuing to refer to FIGS. 1 and 2, the grab handle 2 includes an insulative barrier 10 having a first portion 12, a second portion 14 and a third portion 16. The first portion 12 is structured to at least partially cover a corresponding one of the upper and lower (with respect to FIG. 2) ends of the housing 4. The second portion 14 is structured to couple to the corresponding one of the upper and lower ends of the housing 4. The third portion 16 is structured to be manually grasped in order to pull the insulative barrier 10 together with the circuit breaker 6 away from the mounting block 8 (FIGS. 3 and 4).

As shown in FIG. 1, the insulative barrier 10 further includes a fourth portion 18. The first and fourth portions 12,18 of the insulative barrier 10 form an L-shaped cover. The second portion 14 includes two tongue portions 20,22, each of which has a first free end 24 structured to slide into a corresponding one of the groove portions 26,28 (shown in phantom line drawing in FIG. 1) of the circuit breaker housing 4, and a second end 30 coupled to the fourth portion 18.

As shown in FIG. 2, two endcap circuit breaker removal grab handles 2 are coupled to the housing 4 at the upper (with respect to FIG. 2) side or line side of the circuit breaker 6 and to the housing 4 at the lower (with respect to FIG. 2) side or load side of the circuit breaker. Then, as shown in FIGS. 3 and 4, the circuit breaker 6, including the two handles 2, is mounted (e.g., without limitation, plugged-in) to the example plug-in block 8, which includes line and load power busses 32,34. Then, a maintenance person, such as, for example, a field technician, may readily remove the circuit breaker 6 by grasping the two handles 2 at the third portion 16 thereof and pulling the same and, thus, the circuit breaker 6 away from the plug-in block 8. This action might be needed, for example, if the circuit breaker 6 was in need of testing, repair or replacement. The example endcap circuit breaker removal grab handles 2 cover and electrically isolate the maintenance person from electrically conductive components that carry, for example, the line or load voltages from or to the plug-in block power busses 32,34. As a result, the skilled maintenance person is protected from hazardous voltages during the process of pulling the circuit breaker 6 away from the plug-in block 8 when it might otherwise be possible to accidentally touch the exposed conductive components (e.g., conventional line terminals 35 or load terminals (not shown)), which could possibly cause serious personal injury or death.

Continuing to refer to FIG. 2, the first portion 12 of the insulative barrier 10 includes an upper (with respect to FIG. 2) side structured to be disposed away from the upper end of the housing 4 and a lower (with respect to FIG. 2) side structured to be disposed with the second portion 14 of the insulative barrier 10 toward the upper end. The line and load ends of the housing 4 (as shown with the upper end) include one or more groove portions 26,28 (two groove portions 26,28 are shown in FIG. 2). The second portion 14 of the insulative barrier 10 includes one or more tongue portions 36,38 (as best shown in FIG. 1; two tongue portions 36,38 are shown in FIGS. 1 and 2) structured to engage the respective groove portions 26,28. The tongue portions 36,38 include a member 40 (FIG. 1) disposed from the first portion 12 of the insulative barrier 10. The member 40 includes a locking rib 42 (FIG. 1). The groove portions 26,28 of the housing 4 include a slot 44 (shown in phantom line drawing in FIG. 1) having a channel 46 (shown in phantom line drawing in FIG. 1) structured to receive the locking rib 42. In this manner, a secure joint is made by the tongue portions 36,38 on one side of the handles 2 and the corresponding respective groove portions 26,28 on the circuit breaker housing 4. Although example tongue and groove joints are shown, any suitable mechanism may be employed to couple the handle 2 to the molded base 4 and/or to the circuit breaker molded cover 48.

FIG. 3 shows the circuit breaker 6, including the two endcap circuit breaker removal grab handles 2, as mounted on the plug-in block 8. The third portion 16 of the insulative barrier 10 is a grab handle portion disposed away from the upper (with respect to FIG. 3) side of the insulative barrier 10 and away from the upper end (with respect to FIG. 3) of the molded base 4. The circuit breaker 6 includes a molded cover 48 and the molded base 4, and a plurality (e.g., without limitation, three are shown on FIG. 4) of line terminals 50 and a plurality of load terminals 52 (only one load terminal 52 is shown in FIG. 4) disposed from the example housing formed by the example base 4 and cover 48. The terminals 50,52 are structured to electrically and mechanically engage the mounting block 8 as will be discussed. The upper (with respect to FIG. 3) or line handle device 2 engages the circuit breaker housing 4 at or about the first or upper end, and the lower (with respect to FIG. 3) or load handle device 2 engages the circuit breaker housing 4 at or about the second or lower end. The second portion 14 (FIG. 2) of the insulative barrier 10 is coupled to the molded base 4 at or about the corresponding one of the upper and lower ends. The third portion 16 of the insulative barrier 10 is structured to be manually grasped in order to pull the insulative barrier 10 together with the circuit breaker 6 away from the mounting block 8.

As shown in FIGS. 3 and 4, an electrical switching apparatus 54 includes the circuit breaker 6, the mounting block 8 and the two endcap circuit breaker removal grab handles 2. The mounting block 8 is a plug-in block including a plurality (e.g., without limitation, three) of line openings 56 and a plurality (e.g., without limitation, three) of load openings 58. The circuit breaker terminals 50,52 plug-in to the plug-in block 8 at the respective openings 56,58 thereof. The openings 56,58 correspond to the respective line and load power busses 32,34. The line and load terminals 50,52 include line and load voltages, respectively. The first portion 12 of the insulative barrier 10 at least partially covers the line and load terminals 50,52. Preferably, the grab handle portion 16 includes one or more recesses to receive the maintenance person's fingers as best shown with the upper (with respect to FIG. 4) handle 2 of FIG. 4.

The endcap circuit breaker removal grab handles 2 provide a mechanism to improve electrical isolation safety for maintenance personnel. Furthermore, it also provides a mechanism to easily remove the example molded case circuit breaker 6 from the example plug-in block 8.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A handle apparatus for engaging a housing of an electrical switching apparatus and for removing said electrical switching apparatus from a mounting block, said housing including a first side, a second side adjacent the first side, and at least one groove disposed from the first side, said electrical switching apparatus including a plurality of terminals proximate the first side, said handle apparatus comprising:

an insulative barrier comprising:

a side portion including a first end, an opposite second end, and a panel portion between the first end and the opposite second end, said panel portion including a first side and an opposite second side, a gripping member disposed from the first side of the panel portion at the first end of the side portion, an end portion disposed from the opposite second side of the panel portion at the opposite second end of the side portion, and at least one tongue disposed from the opposite second side of the panel portion, each of said at least one tongue including a free end proximate the first end of said side portion and an opposite end completely coupled to the end portion, wherein the panel portion of said insulative barrier is structured to at least partially cover the first side of the housing of said electrical switching apparatus, wherein each of said at least one tongue is structured to mate with a corresponding one of said at least one groove, wherein said gripping member is structured to be manually gripped in order to pull said insulative barrier together with said electrical switching apparatus away from said mounting block, and wherein said end portion is structured to engage the second side of said electrical switching apparatus when said insulative barrier together with said electrical switching apparatus is pulled away from said mounting block.

2. The handle apparatus of claim 1 wherein the side portion and the end portion of said insulative barrier form an L-shaped cover.

* * * * *